US011107341B2

(12) United States Patent
Little

(10) Patent No.: US 11,107,341 B2
(45) Date of Patent: Aug. 31, 2021

(54) LED SLEEVE FOR EMERGENCY BREATHING SAFETY SYSTEM CONNECTION

(71) Applicant: Jamie Little, Midlothian, VA (US)

(72) Inventor: Jamie Little, Midlothian, VA (US)

( * ) Notice: Subject to any disclaimer, the term of this patent is extended or adjusted under 35 U.S.C. 154(b) by 0 days.

(21) Appl. No.: 16/894,791

(22) Filed: Jun. 6, 2020

(65) Prior Publication Data

US 2020/0388129 A1 Dec. 10, 2020

Related U.S. Application Data

(60) Provisional application No. 62/857,893, filed on Jun. 6, 2019.

(51) Int. Cl.
*G08B 29/00* (2006.01)
*G08B 21/02* (2006.01)
(Continued)

(52) U.S. Cl.
CPC ..... *G08B 21/02* (2013.01); *G08B 5/36* (2013.01); *G08B 21/18* (2013.01)

(58) Field of Classification Search
CPC .. B07C 5/3425; Y10S 101/36; Y10S 209/919; Y10S 209/934; Y10S 264/53; Y10S 362/804; Y10S 362/812; Y10S 430/153; A61L 9/20; B01D 35/143; B41F 23/0406; B41F 23/0426; B41F 23/0463; B41F 23/0466; B41F 27/005; B41F 3/52; D06F 58/22; F21V 3/04; F21V 9/14; F24C 7/004; F26B 13/10; F26B 21/02; F26B 3/283; G01J 1/4209; G01J 1/4223; G02B 5/3008; G02B 5/3025; G02B 6/0008; G02B 6/0095; G03B 27/08; G03B 27/10; G03B 27/16; G03B 27/66; G03B 27/72; G03B 27/73; G03F 3/106; G03F 7/24; G08B 21/02; G08B 21/18; G08B 5/36; G08G 1/096; G09F 19/10; H04N 1/23;
(Continued)

(56) References Cited

U.S. PATENT DOCUMENTS 5,563,004 A * 10/1996 Buzzelli ..... H01M 50/411 429/405
5,721,064 A * 2/1998 Pedicini ..... H01M 10/42 429/407

(Continued)

*Primary Examiner* — Daniel Previl
(74) *Attorney, Agent, or Firm* — Law Office of Jerry Joseph, PLC; Jerry Joseph

(57) ABSTRACT

An air supply indicator apparatus for indicating an amount of breathing air remaining in a cylinder, the apparatus including a housing member having a first side integrally formed with an attachment member, the attachment member configured to be detachably coupled to an emergency breathing safety system (EBSS) or universal emergency breathing safety system (UEBBS) and a second side form with an enclosure, an air status management status indicator having a plurality of indicator light sources disposed on the housing member, and a processor disposed within the enclosure, the processor coupled to the air status management status indicator and configured to emit light from the plurality of indicator light sources based on received signals corresponding to an amount of air remaining in a cylinder.

10 Claims, 7 Drawing Sheets

(51) Int. Cl.
*G08B 5/36* (2006.01)
*G08B 21/18* (2006.01)

(58) Field of Classification Search
CPC ... H04N 3/12; H04N 5/84; H04N 5/85; Y10T 29/49895
USPC ..... 340/506, 501, 540, 603, 945, 961
See application file for complete search history.

(56) References Cited

U.S. PATENT DOCUMENTS 5,864,287 A * 1/1999 Evans, Jr. ..... A62C 37/50 340/506
5,988,518 A * 11/1999 Kawai ..... B60H 1/00964 165/202
6,105,205 A * 8/2000 Takahashi ..... A47L 9/248 15/326
6,152,699 A * 11/2000 Shikata ..... F04D 19/005 417/12
2019/0032911 A1* 1/2019 Lan ..... F21V 3/02
2019/0033170 A1* 1/2019 Dudar ..... F02D 41/221
2020/0102900 A1* 4/2020 Kolhouse ..... F02D 35/027
2020/0123993 A1* 4/2020 Koenigsfeld ..... F02D 41/0077

* cited by examiner

LED SLEEVE FOR EMERGENCY BREATHING SAFETY SYSTEM CONNECTION

BACKGROUND OF THE INVENTION

1. Field of the Invention

The present general inventive concept relates to air supply indicators, and more specifically, to air supply indicators having an illuminated indicator and configured to connect to conventional emergency breathing safety systems (EBSS) and/or universal emergency breathing safety systems (UEBSS) to provide illumination in critical low-light, low-visibility situations.

2. Description of Related Art

Conventional emergency breathing safety systems (EBSS) and universal emergency breathing safety systems (UEBSS) are handheld, air manifolds that allow firefighters to share air from self-contained breathing apparatus (SCBA) cylinders with each other in emergencies. The available EBSS and UEBSS are typically comprised of a metal manifold block with standard, male and female threaded air line fittings on one end and a hose line connecting the manifold to the user's SCBA on the other end.

While these connections allow for a quick connection in normal visibility conditions, they require a lot of dexterity and visual examination to connect properly while being used in low-light, low-visibility, and smoky conditions by users who are wearing fire-resistant gloves.

Therefore, what is desired is a localized, point-source illumination to assist users to properly align, connect and/or disconnect air line fittings in low-light, low-visibility, and smoky conditions, even while wearing fire-resistant gloves.

BRIEF SUMMARY OF THE INVENTION

The present inventive concept fits onto conventional EBSS and/or UEBBS and provides illumination to the EBSS (or UEBBS) connection procedure where seconds can mean the difference between life and death. An object of the present general inventive concept is to enhance the speed of the EBSS connection procedure—and in doing so, potentially saving the lives of firefighters who have run out of air in their SCBA cylinders.

An object of the invention is to provide a means to automatically turn the LED sleeve 100 on and off based on a light detection sensor. However, the present general inventive concept is not limited thereto.

Aspects and/or features of the present general inventive concept is achieved by providing an air supply indicator apparatus for indicating an amount of breathing air remaining in a cylinder, the apparatus includes a housing member having a first side integrally formed with an attachment member, the attachment member configured to be detachably coupled to an emergency breathing safety system (EBSS or UEBBS) and a second side form with an enclosure, an air status management status indicator having a plurality of indicator light sources disposed on the housing member, and a processor (or controller) disposed within the enclosure, the processor coupled to the air status management status indicator and configured to control the plurality of indicator light sources to emit light based on received signals corresponding to an amount of air remaining in a cylinder.

The plurality of indicator light sources may include a first indicator light source, a second indicator light source, a third indicator light source, and a fourth indicator light source.

The first and second indicator light sources may emit a first color light, the third indicator light source may emit a second color light, and the fourth indicator light source may emit a third color light.

The processor may control the first indicator light source to emit the first color light when receiving a signal corresponding to an air supply in the cylinder to be between 75% and 100%. However, these percentage range values may vary as desired.

The processor may control the second indicator light source to emit the first color light when receiving a signal corresponding to an air supply in the cylinder to be between 50% and 75%. However, these percentage range values may vary as desired.

The processor may control the third indicator light source to emit the second color light when receiving a signal corresponding to an air supply in the cylinder to be between 35% and 50%. However, these percentage range values may vary as desired.

The processor may control the fourth indicator light source to emit the third color light when receiving a signal corresponding to an air supply in the cylinder to be between 35% and 0%. However, these percentage range values may vary as desired.

The first color light may be a green color, the second color light may be a yellow color, and the third color light may be a red color.

The air supply indicator apparatus may further include a power source coupled to the processor.

The power source may include one or more rechargeable batteries.

It is briefly noted that upon a reading this disclosure, those skilled in the art will recognize various means for carrying out these intended features of the invention. As such it is to be understood that other methods, applications and systems adapted to the task may be configured to carry out these features and are therefore considered to be within the scope and intent of the present general inventive concept, and are anticipated. With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present general inventive concept. As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present.

By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects features, and advantages of the present general inventive concept, as well as the advantages thereof over existing prior art, which will become apparent from the description to follow, are accomplished by the improvements described in this specification and hereinafter described in the following detailed description which fully discloses the invention, but should not be considered as placing limitations thereon.

DETAILED DESCRIPTION OF INVENTION

Figure 1:
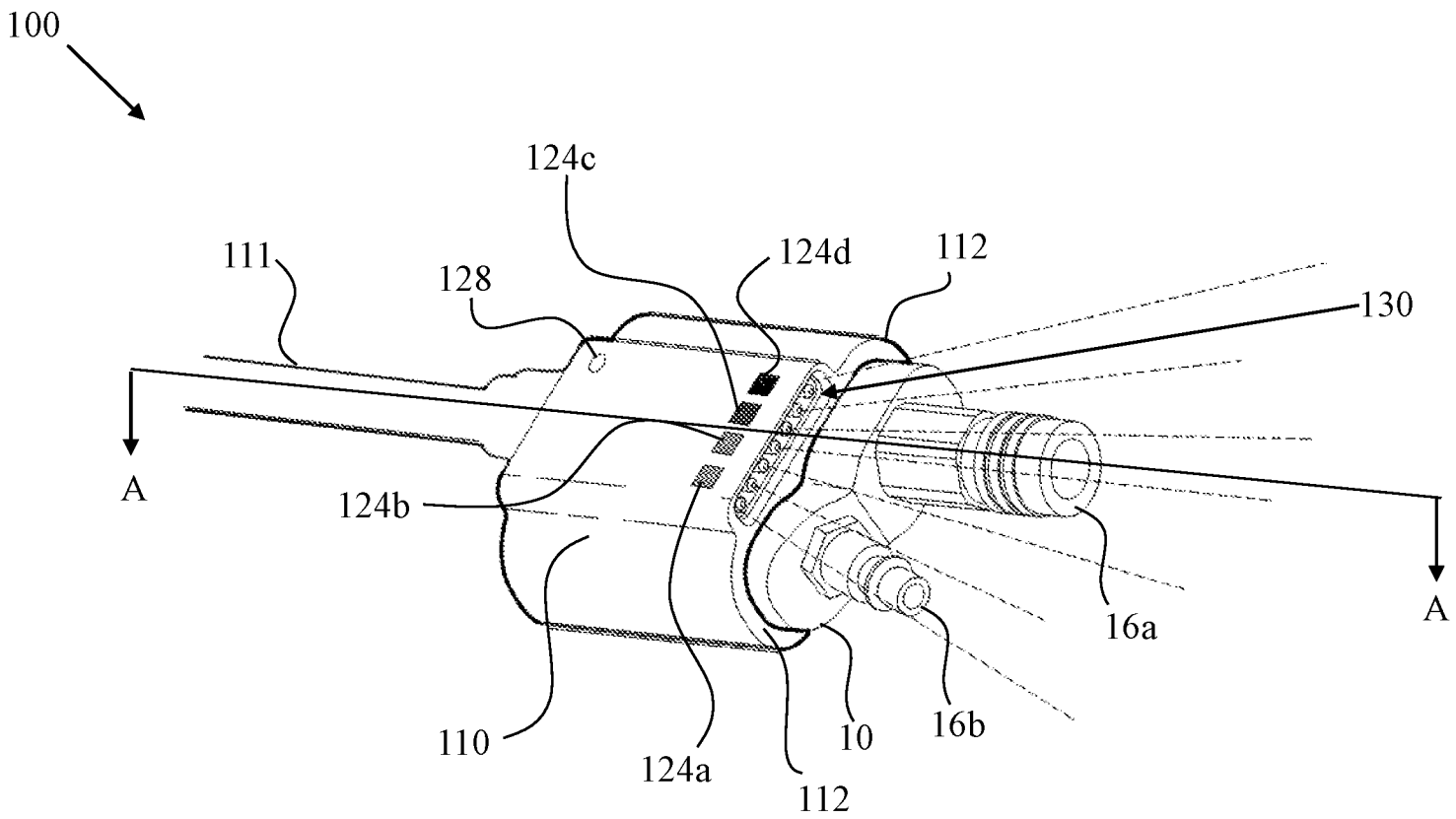
FIG. 1 is a top perspective view of an example embodiment of an Air Supply Indicator apparatus coupled to an emergency breathing safety system, according to the present general inventive concept.

The present general inventive concept provides an Air Supply Indicator apparatus configured to couple to and work with existing emergency breathing safety systems (EBBS) and/or universal emergency breathing safety systems (UEBSS).

The present general inventive concept also provides an Air Supply Indicator apparatus formed as a light-emitting diode (LED) sleeve for existing emergency breathing safety systems (EBSS/UEBSS) that can be used by fire fighters wearing a self-contained breathing apparatus (SCBA).

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 2:
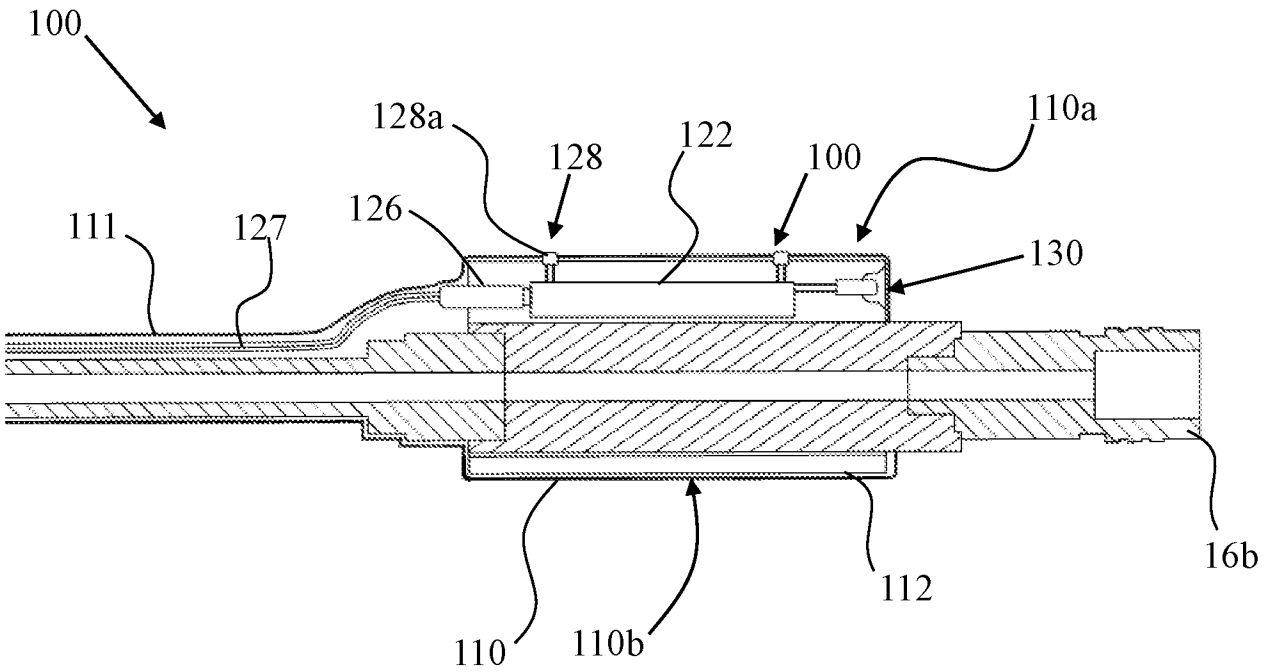
FIG. 2 is a cross-sectional view of the Air Supply Indicator apparatus illustrated in FIG. 1, along line A-A.
Figure 3:
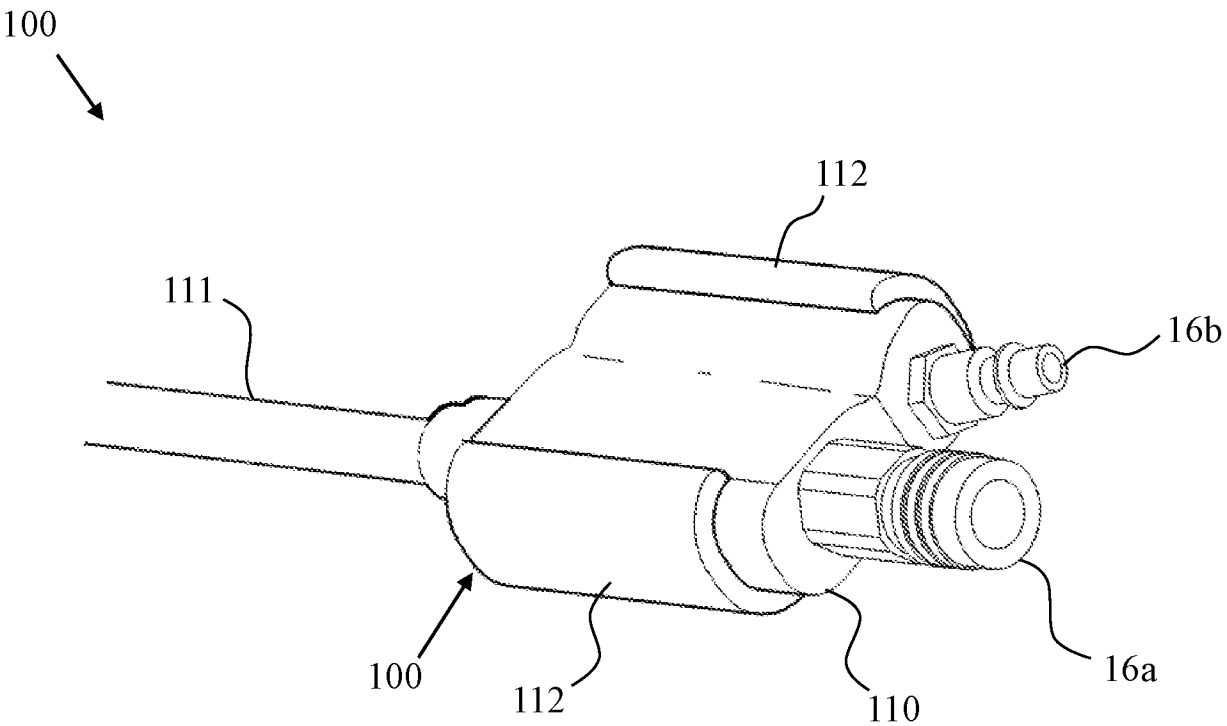
FIG. 3 is a bottom perspective view of the Air Supply Indicator apparatus illustrated in FIG. 2.
Figure 4:
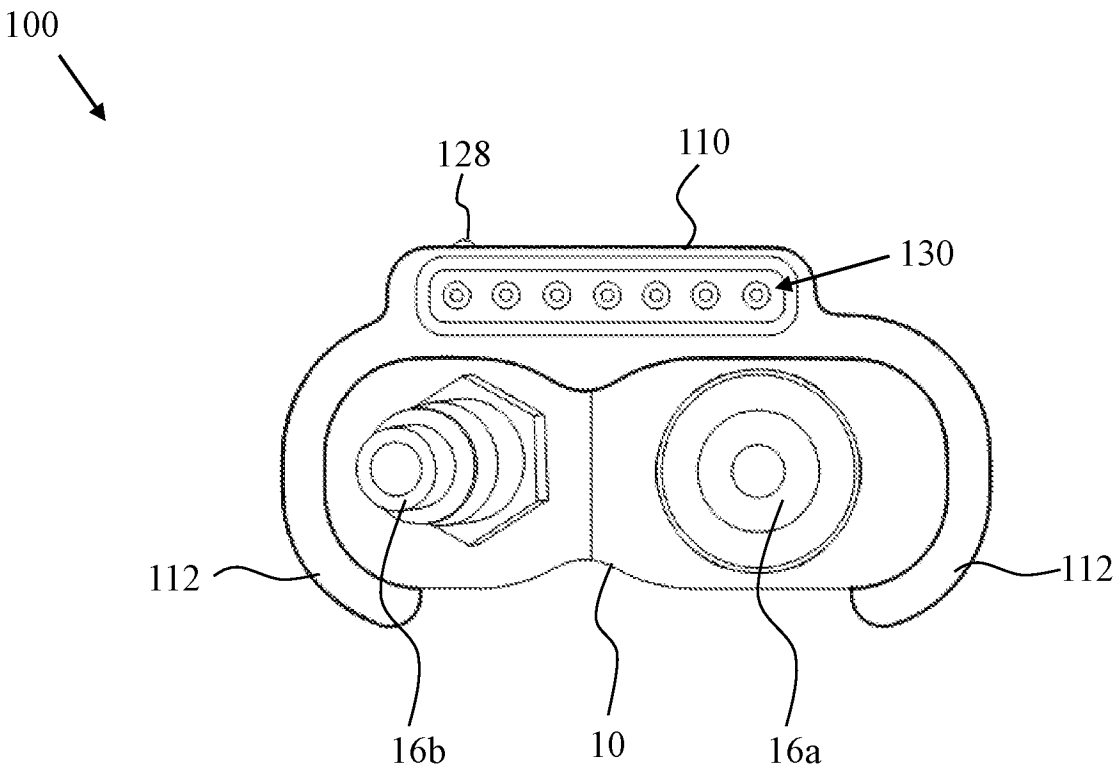
FIG. 4 is a side view of the Air Supply Indicator apparatus illustrated in FIG. 1.

FIG. 1 is a top perspective view of an example embodiment of an Air Supply Indicator apparatus 100 coupled to an emergency breathing safety system (EBSS), according to the present general inventive concept. FIG. 2 is a cross-sectional view of the Air Supply Indicator apparatus 100 illustrated in FIG. 1, along line A-A. FIG. 3 is a bottom perspective view of the Air Supply Indicator apparatus 100 illustrated in FIG. 2. FIG. 4 is a side view of the Air Supply Indicator apparatus 100 illustrated in FIG. 1.

Referring to FIGS. 1-3, in an exemplary embodiment, an air supply indicator apparatus 100 for indicating an amount of breathing air remaining in a cylinder includes a housing member 110 having a first side 110*a* (i.e., a bottom side) formed with an attachment member 112 and an opposing second side 110*b* (i.e., a top side) formed with an air status management status indicator 120. The housing member 110 includes a wiring protection member 111 which extrudes in a direction away from the air status management status indicator 120 and is configured to protect a power cord 127 providing power to the power source 126 used to operate the air supply indicator apparatus 100.

In alternative embodiments, the air supply indicator apparatus 100 may included an independent power source such as but not limited to rechargeable batteries or a dependent power source such as a D.C. power jack wire 230*a* inserted into the wiring protection sleeve member 111 surrounding the air line 14 (shown in FIG. 2) that draws external power from a user's existing fire equipment setup. However, the present general inventive concept is not limited thereto.

That is, in exemplary embodiments, the power cord 127 is configured to run along the input air line 14 and is used to supply power to the air status management status indicator 120 and the plurality of LEDS 130. The wiring protection member 111 extends from the housing member 110 in order to conceal and protect the power cord 127 from damage and for the processor 166 to receive signals from external sensors.

In alternative embodiments, the processor 166 may further include an alarm circuit to emit an audio and/or visual alarm for various situations including, but not limited to, a low air supply within a user's cylinder, an evacuation call, a building collapse call or the like. However, the present general inventive concept is not limited thereto.

The attachment member 112 is configured to be detachably coupled to an emergency breathing safety system (EBSS) 10 and may be formed in various shapes and sizes. The EBSS 10 includes a housing/manifold 12 having a first side 12*a* connectable to an input air line 14 and an opposing second side 12*b* connectable to a first output air line 16*a* and a second output air line 16*b*.

In the present embodiment, the attachment member 112 is formed in a C-shape in order to be easily attached to a conventional EBSS 10. The air supply indicator apparatus 100 further includes a plurality of light sources 130 to provide illumination to help a user when attempting to connect and/or disconnect another user to the EBBS 10 in low light/visibility conditions. However, the present general inventive concept is not limited thereto. That is, in alternative embodiments, the attachment member 112 may be formed in various shapes and sizes to accommodate a size and shape of various EBSS or UEBSS designs.

In alternative embodiments, the housing member 110 may be painted with an ultraviolet paint to further assist users attempting to connect and/or disconnect another user to the EBBS/UEBBS 10 in low light/visibility conditions.

In the present embodiment, the housing member 110 includes a second side 110*b* formed with an enclosure to substantially enclose components of the air status management status indicator 120. The housing member 110 may be formed of a fire-resistant material and materials such as metal, silicone, and the like. However, the present general inventive concept is not limited thereto.

In the present embodiment, the air status management status indicator 120 includes a processor 122 coupled to a plurality of indicator light sources 124 visible through the second side 110*b* of the housing member 110.

In the present embodiment, the processor 122 is coupled to the air status management status indicator 120 and is configured to control the plurality of indicator light sources 124 to emit light based on received signals corresponding to an amount of air remaining in a cylinder (not illustrated).

In the present embodiment, the plurality of indicator light sources 124 may be LEDs that are heat resistant and may be made of a translucent material such as but not limited to thick glass, silicone, or various other heat resistant materials and encased in the second side 110*b* of the housing member 110, which is also manufactured from a heat-resistant material such as, but not limited to, metal, silicone, and the like.

In example embodiments, the plurality of indicator light sources 124 include a first indicator light source 124*a*, a second indicator light source 124*b*, a third indicator light source 124*c*, and a fourth indicator light source 124*d*. However, the present general inventive concept is not limited thereto.

In example embodiments, the first and second indicator light sources 124*a*, 124*b*, emit a first color light, the third indicator light source 124*c* emits a second color light, and the fourth indicator light source 124*d* emits a third color light.

In the present embodiment, the processor 122 controls the first indicator light source 124*a* to emit the first color light when receiving a signal corresponding to an air supply in the cylinder to be between 75% and 100%. However, these percentage range values may vary as desired.

Similarly, the processor 122 controls the second indicator light 124*b* source to emit the first color light when receiving a signal corresponding to an air supply in the cylinder to be between 50% and 75%. However, these percentage range values may vary as desired.

Further, the processor 122 controls the third indicator light source 124*c* to emit the second color light when receiving a signal corresponding to an air supply in the cylinder to be between 35% and 50%. However, these percentage range values may vary as desired.

Finally, the processor 122 controls the fourth indicator light source 124*d* to emit the third color light when receiving a signal corresponding to an air supply in the cylinder to be between 35% and 0%. However, these percentage range values may vary as desired.

In example embodiments, the first color light is a green color, the second color light is a yellow color, and the third color light is a red color. However, the present general inventive concept is not limited thereto.

In example embodiments, the air supply indicator apparatus 100 includes a power source 126 and on/off switch 128 coupled to the processor 122. As such, a user may control when power is to be applied to the processor 122 of the air supply indicator apparatus 100.

In alternative embodiments, the power source may include one or more rechargeable batteries.

In example embodiments, the on/off switch 128 may further include a status LED 128*a* which is configured to illuminate various colors corresponding to different statuses, including, but not limited to, on, off, low battery, battery charged, processor problem, and the like.

Figure 5:
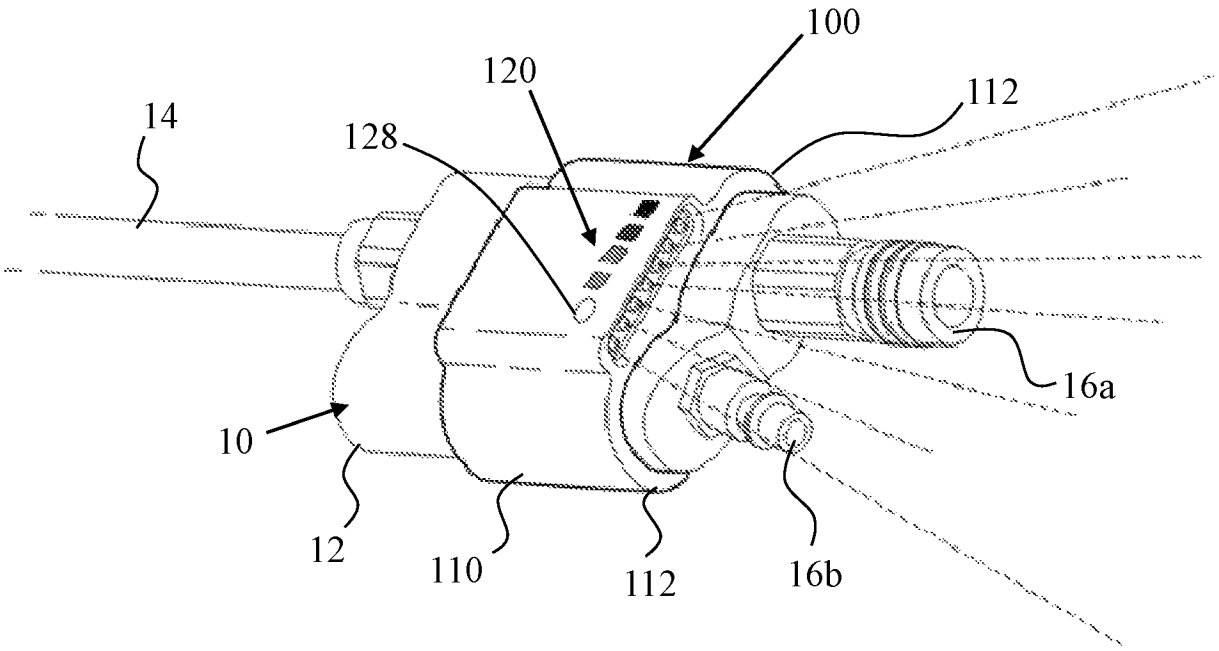
FIG. 5 is a top perspective view of another example embodiment of an air supply indicator apparatus coupled to an emergency breathing safety system, according to the present general inventive concept.
Figure 6:
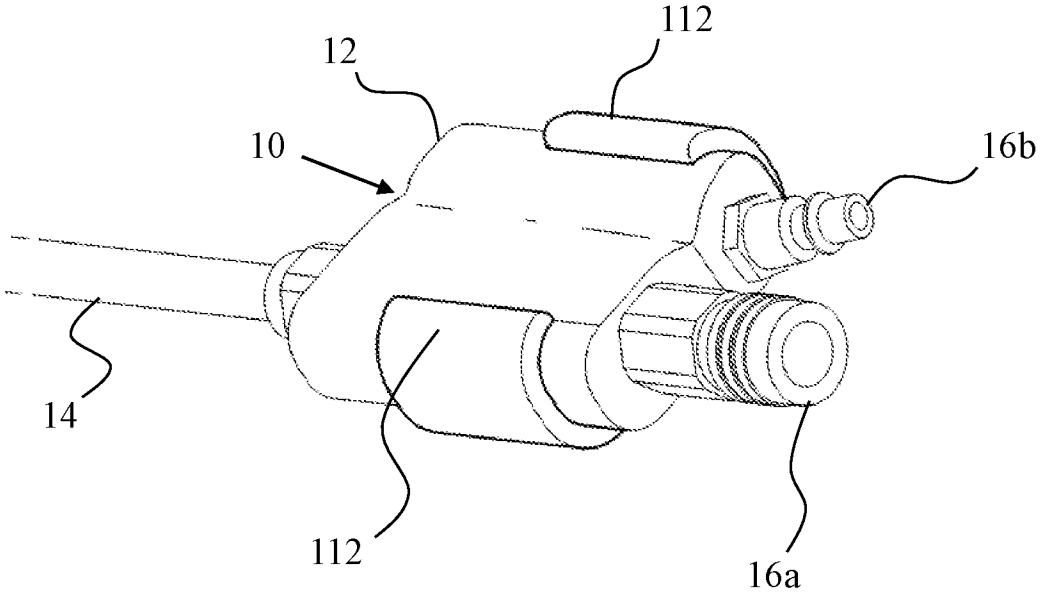
FIG. 6 is a bottom perspective view of the Air supply indicator apparatus illustrated in FIG. 5.
Figure 7:
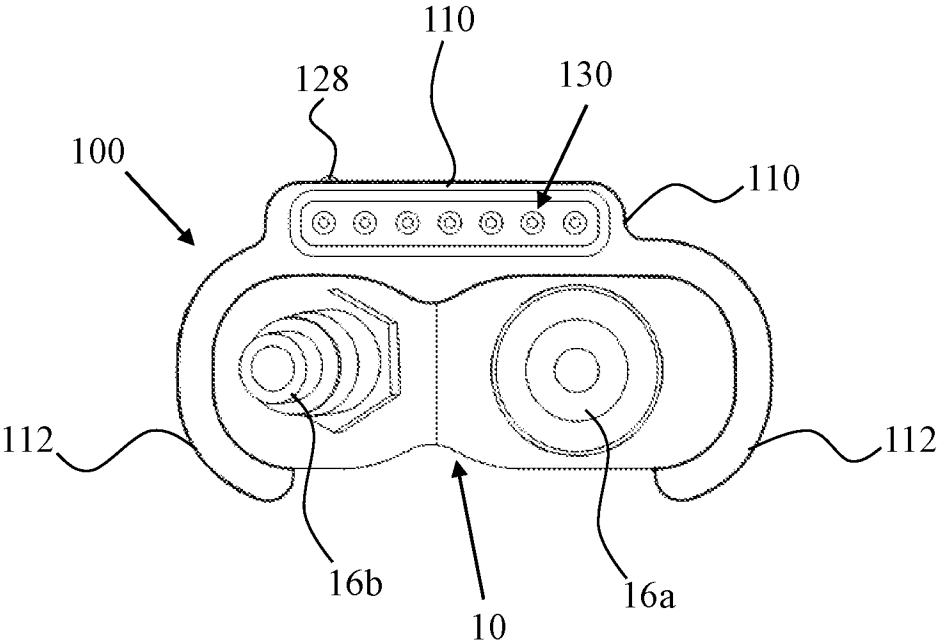
FIG. 7 is a side view of the Air supply indicator apparatus illustrated in FIG. 5.

FIG. 5 is a top perspective view of another example embodiment of an air supply indicator apparatus 200 coupled to an emergency breathing safety system 10, according to the present general inventive concept. FIG. 6 is a bottom perspective view of the Air supply indicator apparatus 200 illustrated in FIG. 5. FIG. 7 is a side view of the Air supply indicator apparatus 200 illustrated in FIG. 5.

Referring now to FIGS. 5-7, in an alternative embodiment, an air supply indicator apparatus 200 is similar to the previous embodiment, except for incorporating wireless communication and/or charging technology and removing the wiring protection member.

In operation, an air supply indicator apparatus is used during immediately dangerous to life or health situation in which another user (e.g. a second user) has a low air supply or completely empty cylinder. In this case, a user (e.g., a first user) would first remove his/her EBSS or UEBSS which has an air supply indicator apparatus according to the present general inventive concept coupled to it.

Next, the first user would retrieve the EBSS or UEBSS from the second user.

Next, the first user would then use the plurality of LEDS of the air supply indicator apparatus to align the female fitting 16*a* of the first user to the male fitting of the second user's EBSS or UEBSS and the male fitting 16*b* of the first user to the female fitting of the second user's EBSS or UEBSS.

Finally, once the connection between the first user's EBSS or UEBSS to the second user's EBSS or UEBSS has been properly made. Air from the first user's cylinder may be shared with the second user.

The air supply indicator apparatus according to the present general inventive concept allows users (e.g., firefighters) to automatically and directly illuminate the first and second user's EBSS or UEBSS in low-visibility, high-stress, and emergency situations. As such, the present invention will significantly increase the likelihood that the connection will be made more efficiently and properly. Further, the plurality of indicator light sources allows users to quickly visualize the status of an amount of air within the cylinders in low-light and visibility conditions.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention.

What is claimed is:

1. An air supply indicator apparatus for indicating an amount of breathing air remaining in a cylinder, the apparatus comprising:

a housing member having a first side integrally formed with an attachment member, the attachment member configured to be detachably coupled to an emergency breathing safety system (EBSS) and a second side form with an enclosure;

an air status management status indicator having a plurality of indicator light sources disposed on the housing member; and a processor disposed within the enclosure, the processor coupled to the air status management status indicator and configured to control the plurality of indicator light sources to emit light based on received signals corresponding to an amount of air remaining in a cylinder.

2. The air supply indicator apparatus of claim 1, wherein the plurality of indicator light sources include a first indicator light source, a second indicator light source, a third indicator light source, and a fourth indicator light source.

3. The air supply indicator apparatus of claim 2, wherein the first and second indicator light sources emit a first color light, the third indicator light source emits a second color light, and the fourth indicator light source emits a third color light.

4. The air supply indicator apparatus of claim 3, wherein the processor controls the first indicator light source to emit the first color light when receiving a signal corresponding to an air supply in the cylinder to be between 75% and 100%.

5. The air supply indicator apparatus of claim 4, wherein the processor controls the second indicator light source to emit the first color light when receiving a signal corresponding to an air supply in the cylinder to be between 50% and 75%.

6. The air supply indicator apparatus of claim 5, wherein the processor controls the third indicator light source to emit the second color light when receiving a signal corresponding to an air supply in the cylinder to be between 35% and 50%.

7. The air supply indicator apparatus of claim 6, wherein the processor controls the fourth indicator light source to emit the third color light when receiving a signal corresponding to an air supply in the cylinder to be between 35% and 0%.

8. The air supply indicator apparatus of claim 7, wherein the first color light is a green color, the second color light is a yellow color, and the third color light is a red color.

9. The air supply indicator apparatus of claim 1, further comprising a power source coupled to the processor.

10. The air supply indicator apparatus of claim 9, wherein the power source includes one or more rechargeable batteries.

* * * * *